United States Patent [19]

Perez

[11] Patent Number: 4,777,806

[45] Date of Patent: Oct. 18, 1988

[54] REFRIGERATED DISPLAY ISLAND

[75] Inventor: Arthur Perez, Buchanan, Mich.

[73] Assignee: Stanely Knight Corporation, New Troy, Mich.

[21] Appl. No.: 81,674

[22] Filed: Aug. 5, 1987

[51] Int. Cl.[4] ..... A47F 3/04

[52] U.S. Cl. ..... 62/256

[58] Field of Search ..... 62/256, 255

[56] References Cited

U.S. PATENT DOCUMENTS

| | | | |
|---|---|---|---|
| 986,875 | 3/1911 | Tilghman | 62/255 |
| 3,365,907 | 1/1968 | Barroero | 62/256 |
| 3,392,544 | 7/1968 | Perez | 62/256 |
| 3,593,538 | 7/1971 | Bachman et al. | 62/256 |
| 4,267,706 | 5/1981 | Abraham | 62/256 |
| 4,283,922 | 8/1981 | Subera et al. | 62/256 |
| 4,373,355 | 2/1983 | Monroe | 62/256 |
| 4,458,501 | 7/1984 | Kooy | 62/256 |

FOREIGN PATENT DOCUMENTS

| | | | |
|---|---|---|---|
| 719434 | 10/1965 | Canada | 62/256 |
| 1379114 | 8/1963 | France | 62/256 |

*Primary Examiner*—William E. Tapolcai

*Attorney, Agent, or Firm*—Lowe, Price, LeBlanc, Becker & Shur

[57] ABSTRACT

An unlimited accessed refrigerated island type display case is described. The case includes a base, a hollow pedestal extending upwardly from the middle of said base and a hood disposed over said base. A refrigeration coil is mounted in said hood, and a first circulating means recirculates cooled air through the coils, through an outlet in the hood, into an inlet in the base, and returns the flow of air to the refrigerator coils. A second inlet in the base then is provided and a second outlet in the hood which together with a second circulating means circulates air from outside upwardly through the pedestal into a plenum chamber surrounding the coils, and outwardly through the second outlet. First and second curtains of air then extend across the display case between the outlets and inlets. A third flow of recirculated cooled air is also directed substantially horizontally across the upper surface of the base to cool articles displayed thereon.

11 Claims, 2 Drawing Sheets

REFRIGERATED DISPLAY ISLAND

This invention relates to a refrigerated display case and in particular to an island type display case wherein unlimited access to merchandise displayed is provided. This invention further relates to an island type display case wherein the entire circumference of the case is accessible to the shopper.

While refrigerated display cases have been available for many years and display cases wherein unlimited access is provided are also well known, the majority of such display cases are of the cabinet style. The term "unlimited access" as used herein refers to the use of an air curtain in place of conventional doors. In such display cases one or more curtains of air are used to keep ambient air away from the refrigerated merchandise so that while conventional doors are not provided, the merchandise remains refrigerated and an undue accumulation of frost is prevented. See, for example my U.S. Pat. No. 3,698,205.

Island type display cases wherein access to the merchandise is provided around the entire circumference of the case are also known. For example in U.S. Pat. No. 3,306,068, an island type display case is provided wherein merchandise is disposed on vertically stacked shelves. A single curtain of refrigerated air surrounds the display area, and a centrally located fan circulates the air. Items on the shelves are cooled by downwardly circulating air from refrigerated coils disposed in a hood thereover.

Similarly, in U.S. Pat. No. 4,267,706 an island type display case is provided wherein a dual curtain of air surrounds the merchandise to be displayed. In this system the compressor is located in the base of the island and refrigerated coils are disposed in the hood. Cooled air is circulated through the coils and then downwardly in an inner curtain whereas ambient air is circulated as an outer curtain. No provision is made for circulating cooled air across or through the items to be displayed, however.

As is known, unlimited access type display cases for perishable items such as flowers require both a curtain of air to keep ambient air away from the merchandise, and an inner circulation of refrigerated air. However, the inner circulation, in the case of flowers, should not impact directly on the petals or it could cause the petals of the flowers to wither. Flower display cases are described in U.S. Pat. Nos. 4,458,501; 4,608,776 and 4,608,835. These display cases are cabinet type display cases which have access only from the front. A curtain of refrigerated air is provided across the front, and refrigerated air from cooling coils in the base of the unit circulates around the bottoms of containers of flowers and along the surface of the shelves supporting the flower vases. In these patents, the coils, fans and associated circulating means are all provided in the base of the unit. In addition to the horizontally circulating flow of air, provision is made for a reduced flow circulating downwardly from the roof of the unit, but this circulation is sufficiently reduced to avoid damage to the flowers displayed.

Island type display cases are of increasing importance in, for example, supermarkets where items should be available for browsing and the like. Island type display cases are normally used for specialty items while the conventional cabinet type displays are used for more stable items. Island type display cases then should be attractive and designed to accommodate a large number of shoppers circulating therearound. However, in order to display impulse items such as flowers, cheeses and the like such island display cases must be refrigerated. Furthermore, such refrigerated display cases should provide for unlimited access to the display of goods without impeding doors or the like.

Such an island display case then must provide for an air curtain around the circumference thereof which will effectively keep ambient air away from the perishable items on display and must also provide a relatively horizontally directed means for cooling the display items without impacting the items from above with a stream of refrigerated air.

It has now been discovered that such a refrigerated display case can be provided in a compact structure preferably measuring about 6 feet by 8 feet. While the structure of this invention is preferred to be octangonal, it could be elliptical, or in fact of any desired configuration. The device of this invention utilizes a dual curtain of air around the entire circumference thereof to keep out ambient atmosphere, and further, circulates a horizontal stream of air around the items on display to thereby maintain the items on display chilled without, in the case of flowers, a wilting effect which can be caused by a downwardly directed stream of refrigerated air.

The preferred structure of this invention utilizes a refrigerated coil in a hood disposed over the items to be displayed with circulating fans in the base. Circulating fans are provided in the base so that ready access is available for maintenance.

The hood is supported by a central, hollow pedestal which also functions to contain circulating ducts, and in fact, the ducts circulate both ambient air to be cooled to the coils, and recirculate cooled air from within the structure to be recooled and recirculated. In the preferred embodiment of this invention then the central hollow pedestal conceals the duct work for a dual circulatory system.

Accordingly it is an object of this invention to provide an island type display case for perishable items which provides unlimited access thereto around the entire circumference of the case.

It is another object of this invention to provide an island type display case which utilizes a dual curtain of refrigerated air around the entire circumference to maintain items on display isolated from ambient atmosphere, and a substantially horizontal flow of refrigerated air to chill the items on display.

It is yet another object of this invention to provide a refrigerated display case for flowers and the like which is compact and provides unlimited access around the entire circumference thereof and which utilizes a dual air curtain around the entire circumference thereof wherein the outer curtain is cooled ambient outside air, and the inner curtain is recirculated cooled air whereby said curtains isolate the articles on display from the ambient atmosphere and which provides a third horizontal flow of air around the items on display which is recirculated.

These and other objects will become readily apparent with reference to the drawings and following description wherein.

Figure 1:
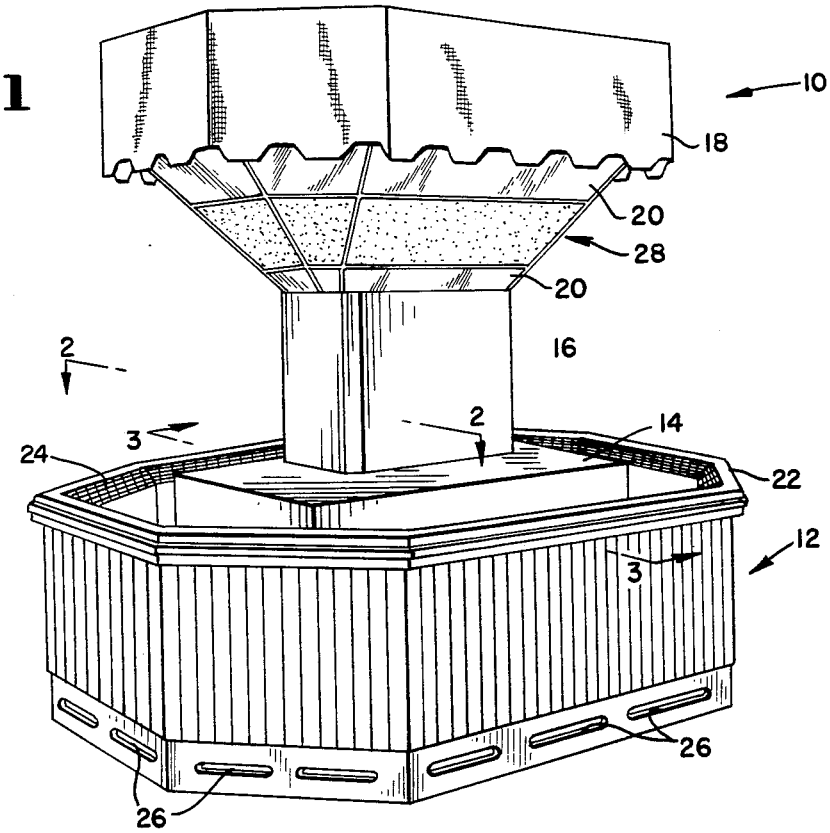
FIG. 1 is a perspective view of a preferred embodiment of the device of this invention.

With attention to the drawings and to FIG. 1 in particular, the refrigerated display island of this invention in its preferred embodiment is octagonal. As noted above however the island of this invention could be any configuration from ellipitical to rectangular if desired. The island includes a top section 10 and a base 12 which supports stepped display shelves 14 and a central pedestal 16 which supports the top 10. Typically the top may be surrounded by a decorative valance 18 and display mirrors 20 could also be mounted in the top section 10.

Preferably, lights (not shown) are disposed behind valance 18 surrounding the circumference of top 10.

The base 12 supports a circumferential molding 22 which mounts a return air grill 24. See FIGS. 2 and 3. A plurality of air inlets 26 are also provided in the lower portion of the base 12.

The top portion 10 also mounts an inlet grid 28 which is divided into an inlet grid 28' for an outer curtain of air and an inlet grid 28" for an inner curtain of refrigerated air as will be subsequently explained. As shown for example in FIG. 3, grids 28' and 28' should be angled so that the curtains are directed toward the inlet grid 24 in the base 12.

Figure 2:
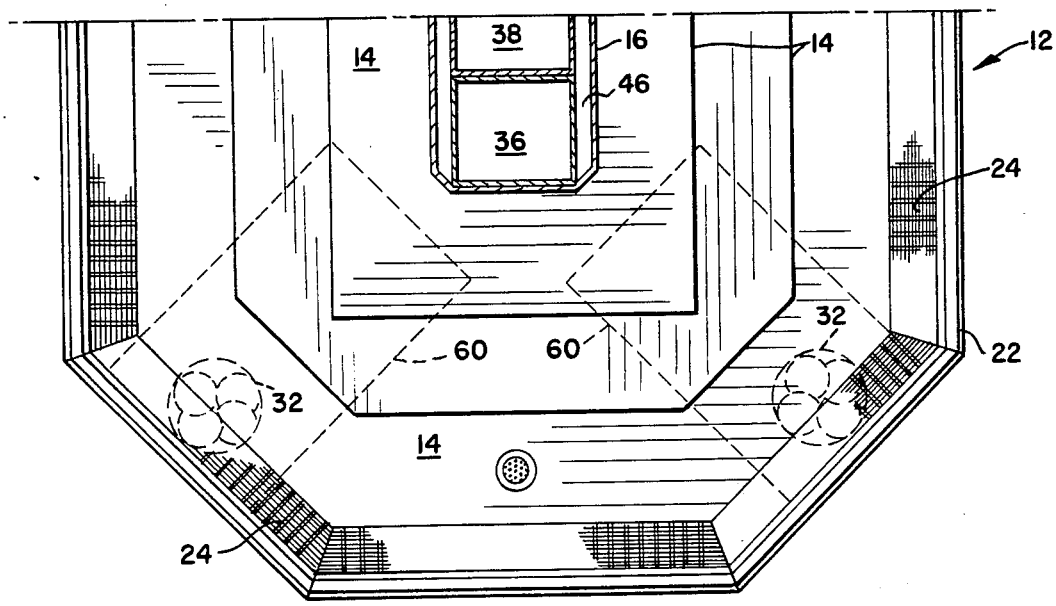
FIG. 2 is a cross-sectional view taken along lines 2—2 of FIG. 1.
Figure 3:
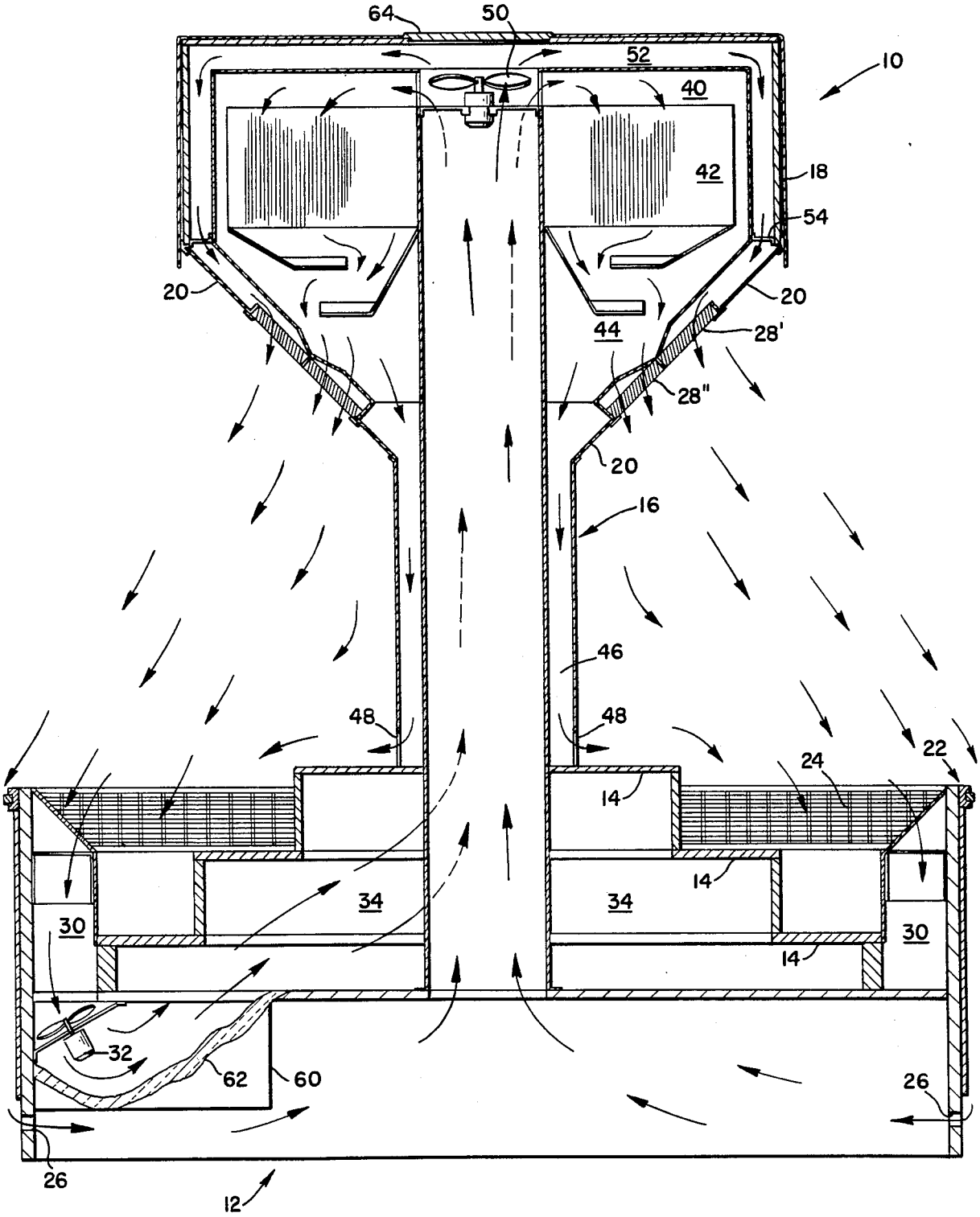
FIG. 3 is a cross-sectional view taken along lines 3—3 of FIG. 1 with the lower fan and duct work included for the purposes of illustration.

With attention to FIG. 3 circumferential inlet grid 24 receive air to be recirculated and to cover a circumferential plenum 30. Preferably four fans 32 are disposed at the angle corners of the base 12 as shown in FIG. 2. Fans 32 then receive the air to be recirculated and direct it through interoor chamber 34, beneath shelves 14 and upwardly through a pair of ducts 36 in pedestal 16. With attention to FIG. 2, only a single duct 36 is shown. However, it should be understood that FIG. 2 is a cross-section through one-half of the device, and a similar duct and fans would be disposed on the other side of central duct 38 said duct being contained within pedestal 16.

With attention to FIG. 3, the air to be recirculated by fans 32 is shown in the central duct portion of pedestal 16 in dotted lines. The air then circulates upwardly through ducts 36 into a plenum 40 and downwardly through refrigerated coils 42 and the air ultimately exits through grill 28" as an inner curtain of refrigerated air. Similarly, the refrigerated air from the interior chamber 44 also circulates downwardly through duct 46 in pedestal 16 to exit at air outlets 48 in a substantially diagonal flow, at an acute angle to the horizontal, across the shelves 14, and therefore, around items on display (not shown). The flow through air outlets 48 then eventually reaches the grid 74 for recirculation by fans 32.

Ambient outside air is admitted through air inlets 26 in base 12 to central duct 38 where it is drawn upwardly by fan 50 into plenum chamber 52. The air circulation is shown in FIG. 3 in solid arrows. The cooled air then circulates through chamber 52, and through resistor grids 54 to exit as an outer air curtain through outlet grids 28'.

As previously noted, FIG. 3 is not a totally accurate cross-sectional view taken along lines 3—3 of FIG. 1. The fan housing 60 for fan 32 has been supplied for the purposes of illustration. As noted therein housing 60 preferably contains an insulated scroll 62 to facilitate the passage of air from circumferential chamber 30 upwardly through chamber 34 to ducts 36 for recirculation.

In a preferred embodiment of this invention coils 42 are mounted in the hood 10 and the remaining components of the refrigeration system (not shown) may be mounted in the base 12 or may be mounted in a remote location with appropriate piping (not shown) to coils 42.

In the preferred embodiment of this invention the fans 32 are disposed in the base as shown in FIGS. 2 and 3. This facilitates maintenance. Fan 50, mounted in the hood 10 is provided with an access plate 64 for maintenance purposes, also.

In a preferred embodiment of this invention the overall dimensions were 75 inches by 95 inches by 92 an $\frac{5}{8}$ inches high. Or about 6 feet by 8 feet. In such a device, the refrigeration capacity desired was found to be 29,000 BTUs per hour at 20° F. Fan 50 has a capacity of about 4 to 5 cubic feet per minute whereas each fan 32 has a capacity of about 225 to 250 cubic feet per minute to adequately circulate air through the structure. This is compared to a normal capacity of 450 cubic feet per minute which would be exhibited in the absence of increased resistance due to the number of turns in the flow paths. The motors for both fans 32 and 50 are rated at 23 watts and may be obtained for example from Electric Motor Specialties of Garrett, Ind. The fan blades were secured from Morrill Motors, Fort Wayne, Ind., and are identified by part No. FF100CW32S for fans 32 and No. FV875CW30P for fan 50.

It will be obvious to those skilled in the art that this invention is not limited to the number and capacity of the fans shown, or to the dimension of the preferred embodiment.

The refrigeration system includes a defrost cycle. It was found that six cycles of thirty-five minutes each in a twenty-four hour period were adequate to maintain flowers on display with a maximization of shelf life.

The display island of this invention then provides an outer curtain of recirculating slightly cooled ambient air and an inner curtain of recirculating cooled air together with a diagonal flow thereof over the stepped display shelves. The circulating system utilizes duct work concealed within a central pedestal wherein three ducts are provided for upwardly directed air to be circulated downwardly and an outer housing duct is provided to supply the diagonal flow of air across the articles to be displayed. The curtains of air completely surround the periphery of the display area so that customers may circulate around the island and select items to purchase. As noted above, it is important that such displays provided unlimited access for customers.

The island of this invention is particularly suited for the display of cut flowers or other items such as cheese and the like wherein it is necessary to provide both easy access to the display and a sufficient cooling capacity so that in the case of flowers they are maintained in desirable form without undue wilting. The combination of air curtains and the flow across the articles to be displayed has provided a highly desirable display case for cut flowers, although as will be obvious to those skilled in the art, other items could be displayed and this invention is not intended to be limited to an island for displaying flowers.

The invention may be embodied in other specific forms without departing from the spirit or essential characteristics thereto. The present embodiments are therefore to be considered in all respects as illustrative and not restrictive, the scope of the invention being indicated by the appended claims rather than by the foregoing description, and all changes which come within the meaning and range of equivalency of the claims ar therefore intended to be embraced therein.

I claim:

1. A refrigerated island display case comprising:

a base mounting display shelves on the upper surface theerof and surrounding the central portion of said surface;

a hood disposed over the central portion of said base having at least one plenum chamber therein;

a hollow pedestal extending between the central portion of said base and the central portion of said hood;

refrigerator coil means mounted in said hood within the plenun chamber for cooling air passing therethrough;

first and second air outlets disposed in said hood and extending around circumference thereof;

first and second air inlets disposed around the circumference of said base;

first air curtain means for recirculating air through said refrigerator coil means, through the first air outlet and through the first air inlet to establish an inner curtain of refrigerated air around the circumference of said base;

second air curtain means for circulating air through the second inlet, upwardly through said pedestal, into said plenum chamber, around said coil means, and outwardly through the second outlet to establish an outer curtain of air around the circumference of said base, and means for diverting a flow of refrigerated air from the first air curtain means across the display shelves including a plurality of third outlets surround said pedestal adjacent said display shelves and third duct means within said pedestal in communication with said first air curtain means and said third outlets.

2. The case of claim 1 wherein said second inlet comprises a plurality of mutually spaced vents in the lower portion of said base.

3. The case of claim 1 wherein said base comprises upstanding side walls extending above and surrounding the display shelves and the first inlet is disposed on the upper inside portion thereof.

4. The case of claim 3 wherein said side walls are disposed in a predetermined, horizontal, cross-sectional configuration.

5. The case of claim 4 wherein the cross-sectional configuration is octagonal.

6. The case of claim 5 wherein said hood has upstanding side walls which define, in horizontal cross-section, an octagon.

7. The case of claim 1 further comprising at least one first vertical duct disposed within said pedestal and said first air curtain means comprises first circulating meahs for circulating air from the first inlet upwardly through said duct, through said coil means and outwardly through said first outlet.

8. The case of claim 7 wherein said base defines an inner circumferential chamber in communication with said first inlet and said circulating means includes first fan means mounted in said base for circulating air from said chamber upwardly into said first duct.

9. The case of claim 8 further comprising at least one second vertical duct is disposed within said pedestal and said second air curtain means comprising second circulating means for circulating air from said second inlet upwardly through said second duct and into the plenum chamber in said hood, and outwardly through the second oulet.

10. The case of claim 9 wherein said second circulating means includes second fan means mounted in said hood for drawing air from said second inlet upwardly through said second duct.

11. The case of claim 1 wherein said first air curtain means further comprises a chamber in said hood disposed below said coil means for receiving a flow of cooled air therefrom, said chamber opening into said first outlet and said third duct means.

* * * * *